US008019496B2

(12) United States Patent
Matusiak, Jr. et al.

(10) Patent No.: US 8,019,496 B2
(45) Date of Patent: Sep. 13, 2011

(54) HUMAN MACHINE INTERFACE FOR SPEED AND LOCATION CONTROL WITH BRAKING DISTANCE DISPLAY

(75) Inventors: Richard Matusiak, Jr., Watertown, NY (US); Folkert Horst, Pierrefonds (CA)

(73) Assignee: New York Air Brake Corporation, Watertown, NY (US)

( * ) Notice: Subject to any disclaimer, the term of this patent is extended or adjusted under 35 U.S.C. 154(b) by 619 days.

(21) Appl. No.: 12/093,217

(22) PCT Filed: Oct. 5, 2007

(86) PCT No.: PCT/US2007/080575

§ 371 (c)(1),
(2), (4) Date: May 9, 2008

(87) PCT Pub. No.: WO2008/045787

PCT Pub. Date: Apr. 17, 2008

(65) Prior Publication Data

US 2008/0306641 A1 Dec. 11, 2008

Related U.S. Application Data

(60) Provisional application No. 60/828,439, filed on Oct. 6, 2006.

(51) Int. Cl.
*G05D 1/00* (2006.01)

(52) U.S. Cl. ..... 701/19; 701/36; 701/70; 246/60

(58) Field of Classification Search ..... 701/19, 701/20, 36, 70; 246/4, 11, 13, 60; 303/7, 303/121

See application file for complete search history.

(56) References Cited

U.S. PATENT DOCUMENTS

| | | | | |
|---|---|---|---|---|
| 4,181,943 | A | 1/1980 | Mercer, Sr. et al. | |
| 5,744,707 | A | 4/1998 | Kull | |
| 6,587,764 | B2 | 7/2003 | Nickles et al. | |
| 7,395,141 | B1 * | 7/2008 | Seck et al. | 701/19 |
| 2001/0029411 | A1 | 10/2001 | Hawthorne | |
| 2003/0200020 | A1 | 10/2003 | Ring | |
| 2004/0064223 | A1 | 4/2004 | Horst et al. | |
| 2005/0192720 | A1 | 9/2005 | Christie et al. | |

OTHER PUBLICATIONS

ETCS, System Requirements Specifications 9SRS) Chapter 2 General Description Versions 3.01, No. of pp. 75 (1996).

Carl Lüddecke; "Die Linienzugbeeinflussung für Schnellfahrten der Deutschen Bundesbahn" Signal und Draht; vol. 57, No. 2 (Feb. 1965); pp. 17-29, XP001147332.

* cited by examiner

*Primary Examiner* — Gertrude Arthur Jeanglaud
(74) *Attorney, Agent, or Firm* — Barnes & Thornburg LLP

(57) ABSTRACT

The present disclosure is directed to a locomotive controller including an input device, a display and a processor for driving the display and receiving inputs from the input device. Software in the processor determines and drives the display to show a location of a train on a track and indicia of the location on the track of stopping distances for one of an emergency brake application, a full service brake application and at least one controlled stop brake application. Creep control is also provided.

13 Claims, 6 Drawing Sheets

AN RCL-CENTRIC ARCHITECTURE

A LEADER-CENTRIC ARCHITECTURE

HUMAN MACHINE INTERFACE FOR SPEED AND LOCATION CONTROL WITH BRAKING DISTANCE DISPLAY

BACKGROUND AND SUMMARY OF THE DISCLOSURE

The development of the LEADER® system by New York Air Brake stems from early work done in the field of train simulation for accident investigations and operations planning. This technology was initially developed as an office application and has now moved to being an onboard, embedded application. LEADER® system simulates the entire train movement in real time and with its look-ahead technology, can predict the train dynamics on a forward looking basis. This capability is used to provide the engineer with "driver assist prompts" in order to optimize the train handling with respect to in train forces, fuel economy, standard operating practices and time to destination. These parameters are weighted according to the requirements of the client railroad. An explanation of the LEADER® system is found in U.S. Pat. No. 6,587,764.

The development of locomotive remote control technology in the early 1980's was based on the concept of using the computational power of an on board computer to replace the knowledge and expertise of a locomotive engineer operating a locomotive in railroad hump and flat yard applications. This so called "engineer-in-a-box" concept was accepted by the railroad industry and the government regulators largely.

Moving a train outside of the hump and flat yards requires an additional level of expertise to deal with train control and train dynamics issues. In order to continue respecting the division of labor within the railroad the "engineer-in-a-box" needs to be more sophisticated to deal with these new situations.

The powerful simulation and computational capabilities that have been developed for the LEADER® system are particularly well suited for this task. The LEADER® system is able to simulate the train operation and dynamics in real time and provide a locomotive engineer with command prompts to optimize the control of the train. The LEADER® system can be extended to have a "cruise control" feature that interfaces directly with the controls on the locomotive in order to control the speed of the train. This same technology can be used to relieve a locomotive remote control operator RCO of the expertise required to handle the train through complex undulating territory. Commands are generated by the LEADER® system and enacted by the RCL system so that the RCO simply needs to indicate the desired speed and stop location for the train.

Critical to the success of this LEADER® mode of operation will be the human-to-machine interface HMI that allows the RCO to interact with the system in a manner that will clearly indicate his intentions for the move and yet not distract the RCO from the primary duties of monitoring the wayside signals, negotiating routing and observing that the track remains clear.

Speed control devices for trains with operator interface and safe guards are shown in U.S. Pat. No. 4,181,943. Also, the display of stopping a distance for emergency brake application, full service brake application or a selectable brake application is described in U.S. Pat. No. 5,744,707. Although bits and piece have been known, a more complete system is required.

The present disclosure is directed to a locomotive controller including an input device, a display and a processor for driving the display and receiving inputs from the input device.

Software in the processor determines and drives the display to show a location of a train on a track and indicia of the location on the track of stopping distances for one of an emergency brake application, a full service brake application and at least one controlled stop brake application.

The controller includes an output and the processor provides at the output one of the brake applications selected by inputs from the input device. The processor may also provide at the output a creep speed signal selected by a creep input from the input device. The processor may determine the stopping distances from a requested speed input from the input device and drives the display to show the speed inputted.

The processor may determine and drive the display to show the current speed of the train and determines the stopping distances from the current speed. The processor determines the stopping distances from a maximum speed input from the input device and drives the display to show the maximum speed inputted.

The processor may determine and drive the display to show the indicia on the track of stopping distances relative to the present location of the train on the track for an emergency brake application, a full service brake application and a controlled stop brake application. Alternatively, the processor may determine and drive the display to show indicia on the track of stopping distances relative to an inputted stopping location on the track for an emergency brake application, a full service brake application and a controlled stop brake application.

The processor removes the stopping distance indicia or does not display the stopping distance indicia if the train is past the location of the indicia on the track.

The controller includes a brake control and a traction control (propulsion and dynamic braking) responsive to signal at the output to control the brakes and propulsion of the locomotive. The controller may be a portable RCL device and the output is wirelessly connected to the brake control and the traction control of the locomotive.

The present disclosure is also directed to a locomotive controller including an input device, an output, a display and a processor for receiving inputs from the input device, driving the display and providing outputs on the output. Software in the processor provides at the output braking and traction signals to achieve a creep speed signal selected by a creep input from the input device.

These and other objects, features, and advantages of the present disclosure may be better understood and appreciated from the following detailed description of the embodiments thereof, selected for purposes of illustration and shown in the accompanying drawings.

DETAILED DESCRIPTION

Figure 1:
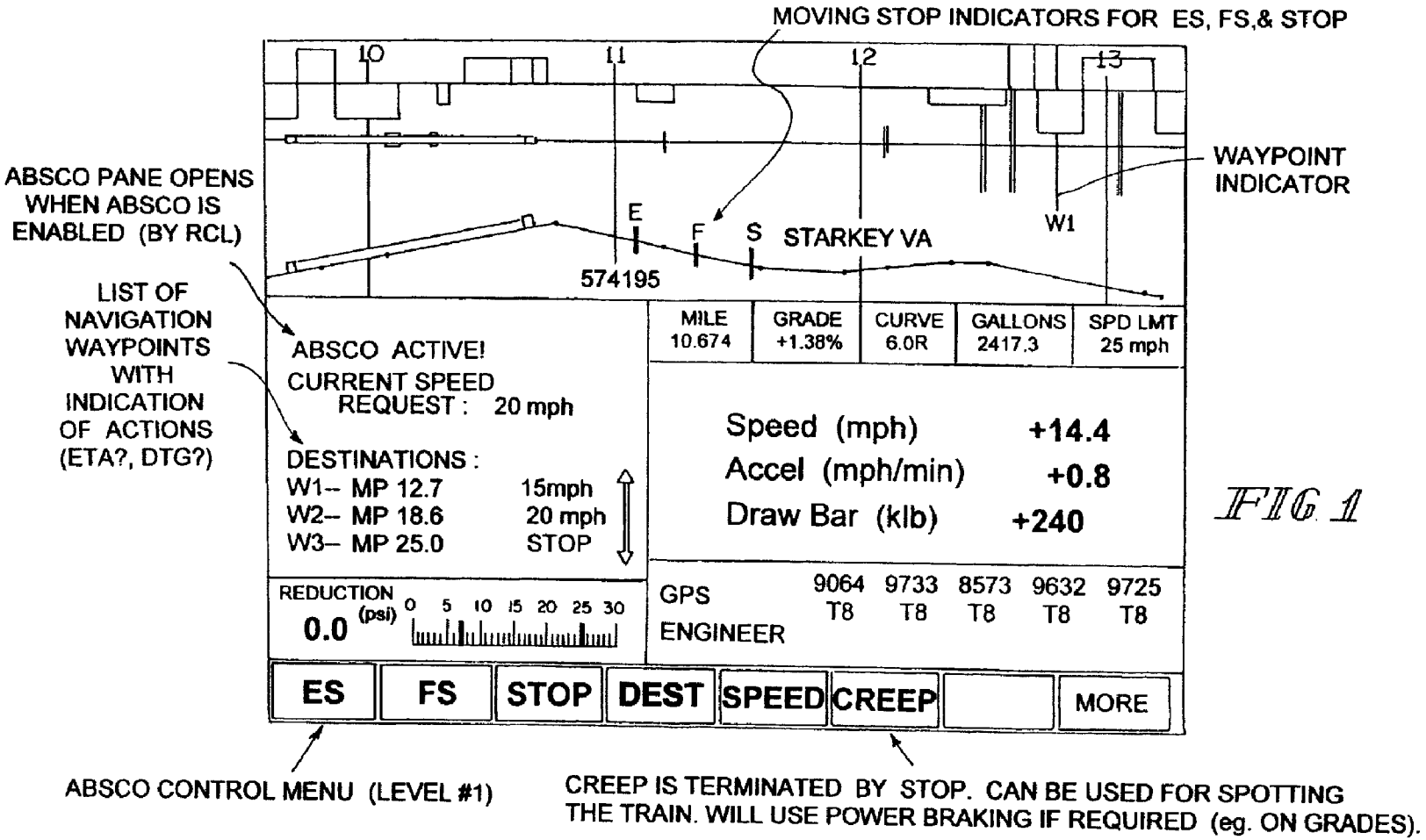
FIG. 1 show displays of stopping distances of the present disclosure with controls for stopping.

The following explores various high level architectures, control strategies and HMI strategies that might be used to implement this functionality.

Operator Control Requirements

The Operator requires the following control inputs in order to effectively control the system:

- means to initiate train movement
- means to enter the desired maximum speed
- means to stop the train (Emergency stop ES, full Service stop FS, STOP)
- means to enter a stop location
- means to move to a specific location
- means to precisely locate the train (spotting)
- means to configure the system General Control Philosophy In general the LEADER® system is in a better position than the operator to provide optimal train handling and trip control due to its simulation and computational capability coupled with its knowledge of the train make-up, location and track database. The Operator assumes ultimate responsibility for the movement, in particular:

| | |
|---|---|
| Speed limits | Satisfying alerter function |
| Track authorities | Horn/Bell control |
| Stopping location | Line of sight train occupancy |
| Monitoring train movement | |

It is suggested that the Operator only enter maximum speed limits (not necessarily related to track speed limits) and allow LEADER® system to optimally control the train. Optimization parameters (e.g., In train forces, time-to-destination, etc.) can be predetermined by the railroad. Allowing the Operator to enter a Stop location (rather than simply commanding a STOP) allows the system to optimally control the trip.

Initiating Train Movement

The challenge of initiating train movements is in managing the take-up of slack and managing rollback (if starting on a grade). Another issue is managing the cycle braking restrictions of the train brake if the move is short and does not allow sufficient time for recharge of the brakes. This may require power braking or creep control A new movement is signaled by the entry of a non-zero speed set point and a destination while the train is stopped. The LEADER® system may manage the rollback, slack and train acceleration. The RCL system may access the locomotive controls and interfaces.

Speed Control

Speed control is achieved by using the locomotive traction (throttle) system, automatic train brake, dynamic brake and/or independent brake as indicated by the constraints programmed into the system. LEADER® system controls the speed of the locomotive according to the constraints programmed into the system at all time respecting the maximum speed indicated by the RCO operator. The system can also be programmed to enforce the maximum track speed. The system may display the actual speed, operator indicated maximum speed as well as the maximum track speed allowed. The system may notify the operator if the requested maximum speed is greater than the posted track speed limit.

During speed control, the train speed could vary anywhere between a Min Speed (programmed in the system) and the operator indicated maximum speed. Generally time-to-destination will be minimized while respecting the rail roads requirements for maximum train dynamics and fuel conservation. These parameters can be adjusted as desired by the railroad.

ES, FS, STOP Control

ES applies an immediate Emergency Brake application. ES is not recoverable until the train has come to a complete stop. FS applies an immediate Full Service Brake application. FS is not recoverable until the train has come to a complete stop however it can be upgraded to an ES.

STOP will bring the train to a controlled stop, respecting the desired limits of in-train forces. STOP is not recoverable until the train has come to a complete stop however it can be upgraded to an FS or ES. The controlled stop is a selected brake application less than full service. More than one controlled stop may be entered at one time and the results calculated and displayed.

Figure 2:
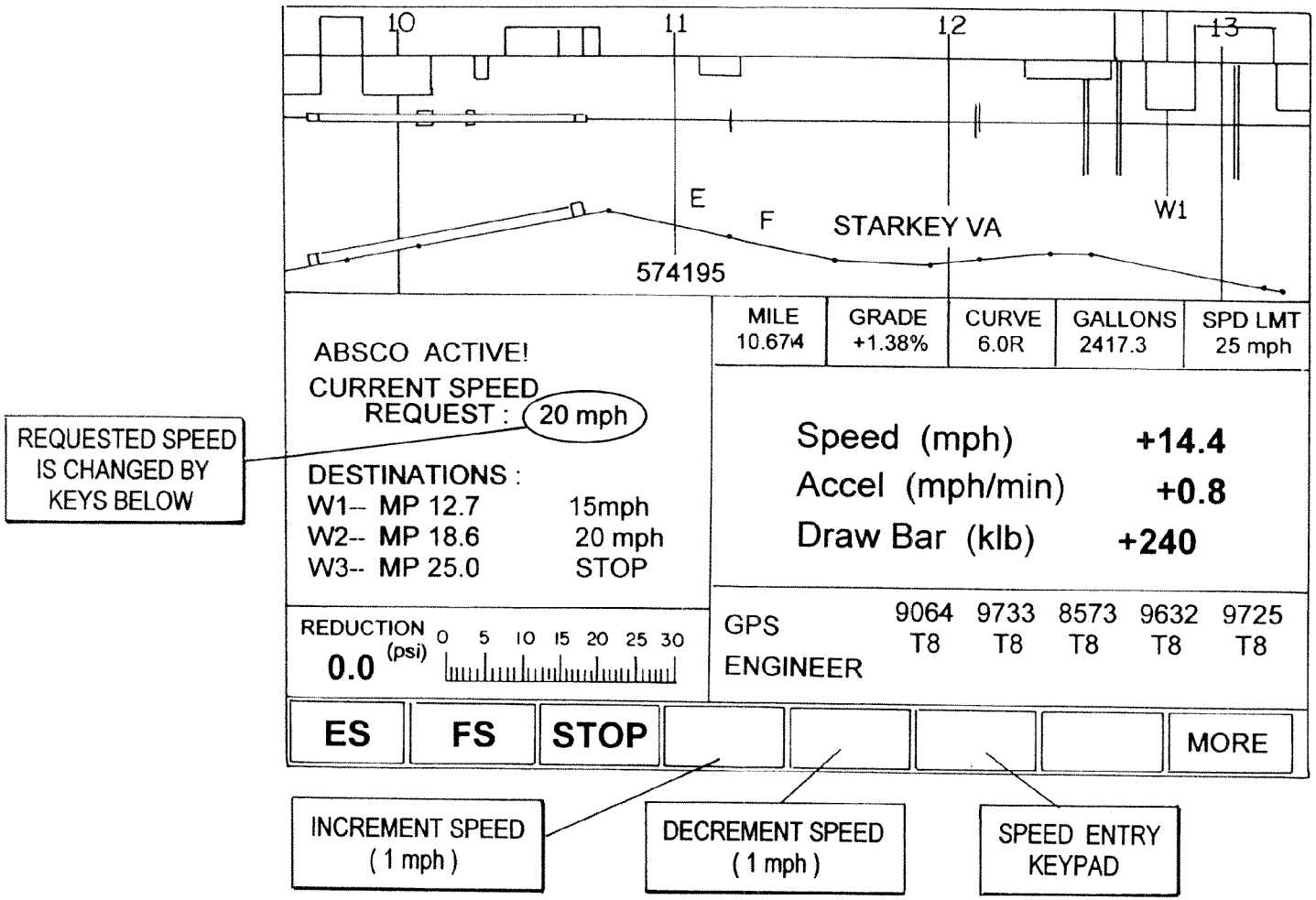
FIG. 2 show displays of stopping distances of the present disclosure with controls for setting speed.
Figure 3:
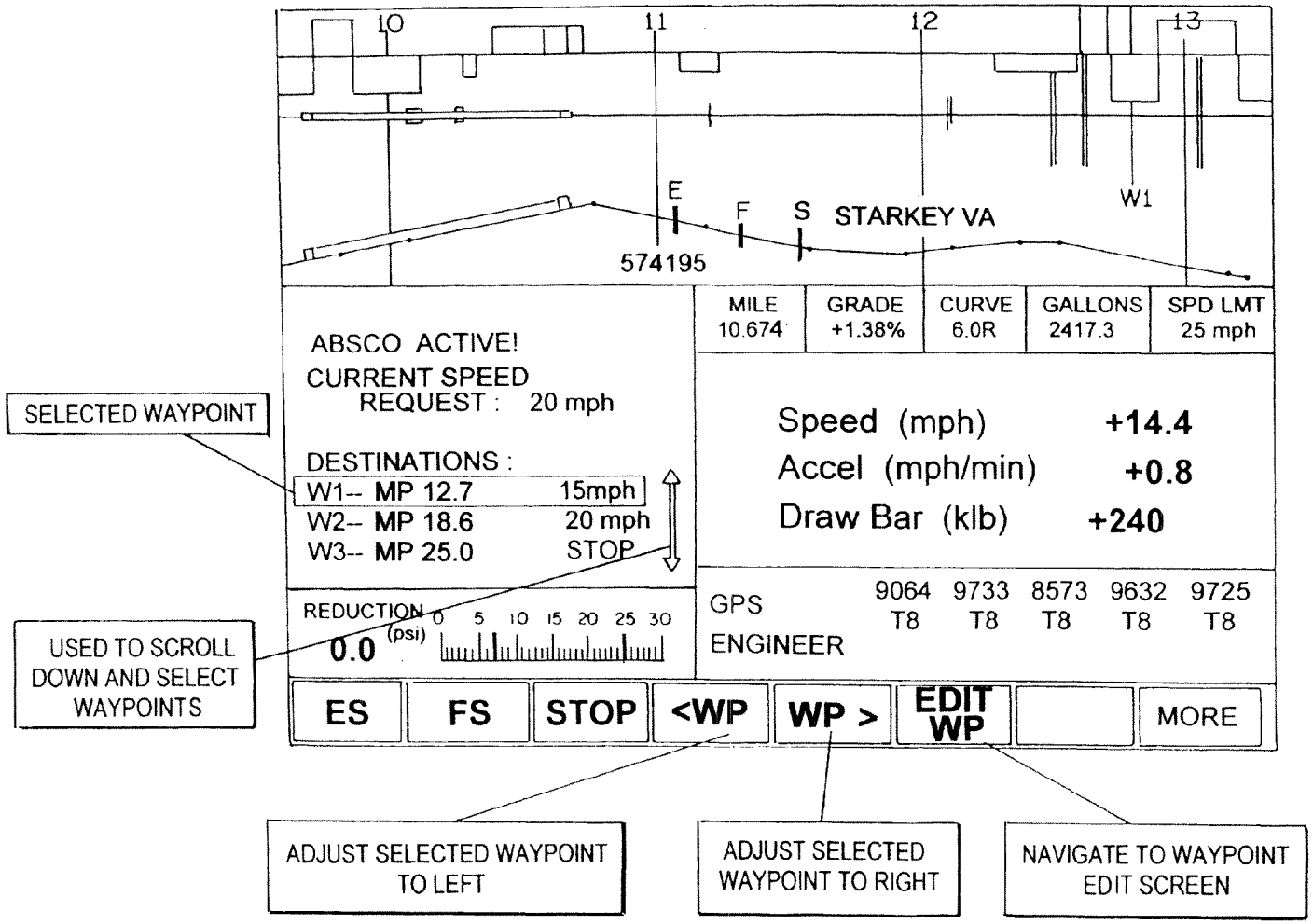
FIG. 3 show displays of stopping distances of the present disclosure with controls for WayPoint adjustment and edit.

A graphic indicator on the profile display will at all times indicate the projected stop location for ES (red); FS (amber) and STOP (green) as shown in FIGS. 1-3.

Stop Destination Control

The system offers the means to assist in optimum train handling from the start to stopping the train at a precise location or destination. The operator enters a destination and a trip plan including speeds and locations (a minimum trip plan consists of minimum and maximum speed and a destination). Using the moving stop indicators, the operator could issue the STOP command at the precise moment that the projected stop indicator passes over the desired stopping location.

Alternatively, the operator moves the Destination cursor to the desired location for a stop. The system will then plan and control the most effective traversal and stopping trajectory to achieve the desired stop. The Destination cursor can be moved by using the right/left arrow keys or by entering the destination milepost. (Note that the MP entry can be used for coarse entry and the arrows can be used for finer adjustments.)

During the STOP sequence adjustments can be made to the destination by adjusting the cursor. At some point, the changes can no longer be entered and the cursor control keys will go blank to indicate this. At this point the operator still has the opportunity to use the ES, FS or STOP keys to achieve a more prompt stop.

The Destination CLEAR button can be used to delete the destination location. Note that at this point, the brakes may be released and the traction reapplied in order to achieve the desired speed. Stopping distances may be affected due to the recharge requirements of the brake system. The operator can adjust or abort navigation at any point during the trip, stop the train or revert to speed control. The operator must acknowledge and approve movement to each successive waypoint. Precise movements will at times require placement or locating the train on the track data base.

CREEP function will allow management of short movement with power braking if required. CREEP will also allow a more precise stopping at the desired location by accelerating the brake application and proceeding at a low speed in the final phase. This may be archived by applying the brake, dynamic braking or reducing the propulsion. The CREEP function allows the operator to enter the intent to stop in a short distance and allows the system to place the train safely in the condition to allow a quick stop.

Modes of Operation

The modes are tied in to an RCL system and operated by RCO (less trained than Engineer). RCO may not use Control Stand controls. LEADER® system controls train speed and stopping destination based on best train handling and fuel conservation practices. LEADER® system provides brake and throttle controls to RCL which actuates systems on the locomotive. LEADER® system provides the HMI as the display and data entry and editing.

Some commands may be derived from the RCL, other commands from the HMI. The RCL control panel (OCU) provides independent and redundant ES, FS, STOP controls, direction controls, Alerter functions, horn/bell, headlight and other locomotive function's controls.

Figure 4:
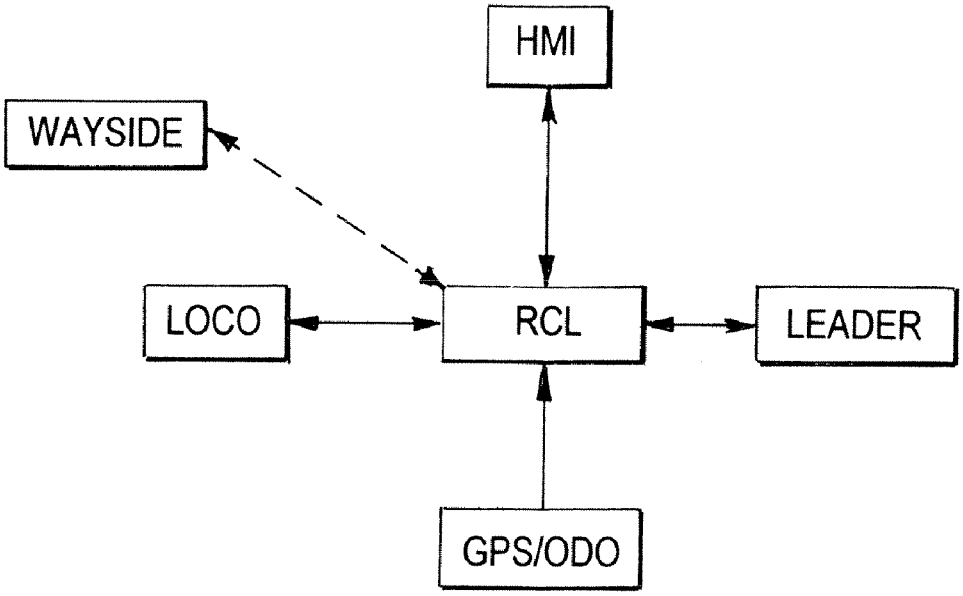
FIG. 4 is a block diagram of an RCL centric architecture.
Figure 5:
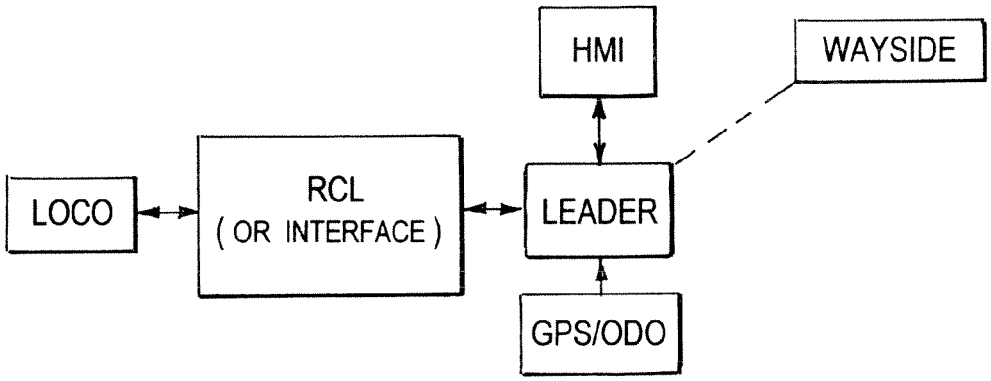
FIG. 5 is a block diagram of a LEADER® centric architecture.
Figure 6:
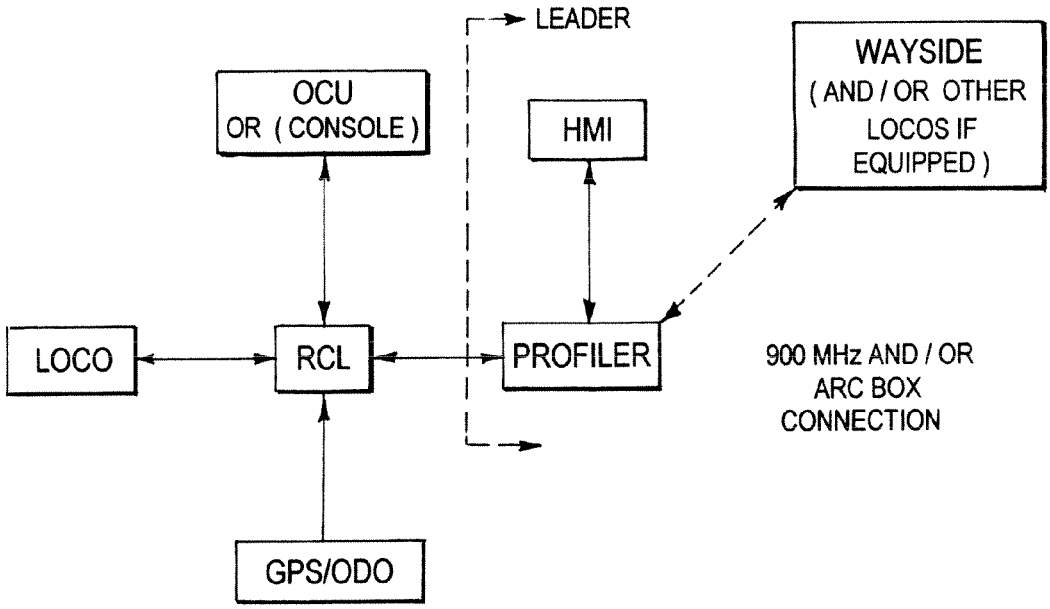
FIG. 6 is a block diagram of another LEADER® centric architecture.

Various architectures are shown in FIGS. 4, 5 and 6.

In Cruise Control (Autopilot), the Locomotive Engineer remains in charge. The LEADER® system controls train speed (and stopping destination) based on best train handling and fuel conservation practices and provides brake and throttle controls to a locomotive actuation interface (could be RCL).

In Engineer Assist, the Locomotive Engineer is in charge of train and affects all controls via the conventional control stand interface. The LEADER® system provides driver assist prompts to assist in optimized train handling.

Route

Routes are collections of Waypoints or control points. A route has an associated direction. A route has a name. Standard Routes are available from Base Station and can be loaded into the system.

Waypoints

Waypoints have an associated Milepost (MP) location and waypoint type. Waypoints have an incremental label (W1, W2 . . . ) relative to the particular route. When waypoints are inserted or deleted from a route, the waypoint designation may change in order to retain the sequence. See FIG. 3, Waypoint Types.

| | |
|---|---|
| Change Speed | Alert |
| Stop | Horn |
| Creep | Bell |

Actions

The following are actions to be taken:

| | |
|---|---|
| Upload Waypoint/Routes from Base Station | Select/Edit/Save Existing Waypoint |
| Create new Waypoint | Select/Edit/Save Existing Route |
| Save new Waypoint | Delete Waypoint |
| Create new Route | Delete Route |
| Save new Route | Select Route |
| Stop Navigation | Override speed of current leg (Waypoint) |

ALERTS/Notification

When approaching waypoint W(x) do you wish to (insert action) and proceed to next waypoint W(x+1)?

Upon approaching STOP, do you wish to CREEP to STOP?

If selected SPEED is greater than waypoint speed or track speed, do you wish to proceed?

Accordingly, it will be understood that the preferred embodiment of the present invention has been disclosed by way of example and that other modifications and alterations may occur to those skilled in the art. Although the use of the LEADER system and displays has been discussed for use on an RCL device, the disclosed processes and displays may be used on any locomotive display.

What is claimed:

1. A locomotive controller comprising:

an input device configured to receive input information from a user, a display configured to provide at least visual output of information to the user, and a processor configured to drive the display to output the information to the user and receive input information from the user via the input device, wherein the processor includes and is further configured to run software that includes instructions that direct the processor to determine a location of a train on a track and the location on the track of stopping distances relative to the present location of the train on the track for at least two of an emergency brake application, a full service brake application and a controlled stop brake application, and wherein the software further includes instructions that direct the processor to drive the display to show the determined, present location of the train on the track and the location on the track of the determined stopping distances relative to the displayed present location of the train on the track for the at least two of the emergency brake application, the full service brake application and the controlled stop brake application.

2. The controller of claim 1, wherein the software running on the processor instructs the processor to receive a user's selection of one of the controlled stop brake applications via the input device and the software running on the processor instructions the processor to drive the display to show an indicia of a result of the received selection on the display.

3. The controller of claim 2, wherein the software running on the processor instructs the processor to drive the display to show an indicia of a result of a received creep speed signal in response to receipt of a creep input selected by the user via the input device.

4. The controller of claim 1, wherein the software running on the processor instructs the processor to determine the stopping distances based on a requested speed input via the input device and the software further instructs the processor to drive the display to show an indicia of the result of the requested speed.

5. The controller of claim 4, wherein the requested speed input is one of an actual applied speed and a proposed speed.

6. The controller of claim 1, wherein the software further instructs the processor to determine a current speed of the train and the stopping distances based on the current speed and the software further instructs the processor to drive the display to show an indicia of the determined current speed and the determined stopping distances.

7. The controller claim 6, wherein the software further instructs the processor to determine the stopping distances based on a maximum speed input via the input device and the software further instructs the processor to drive the display to show the maximum speed inputted.

8. The controller of claim 1, wherein the software further instructs the processor to determine stopping distances relative to the present location of the train on the track for an emergency brake application, a full service brake application and a controlled stop brake application and the software further instructs the processor to drive the display to show the determined stopping distances relative to the displayed present location of the train.

9. The controller of claim 1, wherein the software further instructs the processor to drive the display to show indicia on the track of stopping distances relative to an inputted stopping location on the track for an emergency brake application, a full service brake application and a controlled stop brake application.

10. The controller of claim 9, wherein the software further instructs the processor to remove the stopping distance indicia or omit the stopping distance indicia if the train is past the locations of the corresponding indicia on the track.

11. The controller of claim 2, further comprising a brake control and a traction control responsive to signal at the output to control the brakes and traction of the locomotive.

12. The controller of claim 11, wherein the controller is a portable device and the output is wirelessly connected to the brake control and the propulsion control.

13. A locomotive controller comprising:

an input device configured to receive input information from a user, an output device, a display configured to provide at least visual output of information to the user, and a processor configured to receive input information from the input device, drive the display and provide output information to the output device, wherein the processor includes and is further configured to run software that includes instructions that direct the processor to provide, at the output device, braking and traction signals to achieve a creep speed signal input from the input device.

* * * * *